US005307254A

United States Patent [19]

Russello et al.

[11] Patent Number: 5,307,254

[45] Date of Patent: Apr. 26, 1994

[54] LIGHT FIXTURE WITH DETACHABLE REAR MOUNTING BOX

[75] Inventors: Thomas Russello, Howell; Richard Sangiamo, Linden, both of N.J.

[73] Assignee: The Genlyte Group Incorporated, Secaucus, N.J.

[21] Appl. No.: 965,229

[22] Filed: Oct. 23, 1992

[51] Int. Cl.[5] ..... F21S 1/06

[52] U.S. Cl. ..... 362/368; 362/147; 362/375; 362/457

[58] Field of Search ..... 362/368, 362, 145, 147, 362/152, 375, 457

[56] References Cited

U.S. PATENT DOCUMENTS 4,337,507 6/1982 Lasker ..... 362/300 X
4,403,278 9/1983 Flood ..... 362/368 X
4,449,168 5/1984 Ewing ..... 362/147 X
4,459,648 7/1984 Ullman ..... 362/147 X
4,460,948 7/1984 Malola ..... 362/147 X
4,590,544 5/1986 Decandia ..... 362/368

*Primary Examiner*—Larry Jones
*Attorney, Agent, or Firm*—Kane, Dalsimer, Sullivan, Kurucz, Levy, Eisele and Richard

[57] ABSTRACT

The lighting fixture includes a mounting box and a component assembly. The mounting box can be oriented in a first direction for a recessed box mounting and wiring configuration or in a second direction (180° from the first direction) for a surface conduit mounting and wiring configuration. The mounting box is mounted first and initial wiring connections are made, then component assembly is mounted on the mounting box.

9 Claims, 6 Drawing Sheets

LIGHT FIXTURE WITH DETACHABLE REAR MOUNTING BOX

This application is related to application Ser. No. 7/965,209 filed Oct. 23, 1992 entitled "Light Fixture With a Reversible Lens With Adjustable Brackets" and to U.S. Pat. No. 5,249,110 filed Oct. 23,1992, entitled "Light Fixture With Adjustable Bulb and Radiant Heat Dissipating Reflector".

BACKGROUND OF THE INVENTION

1. Field of the Invention

This invention pertains to a light fixture with a detachable rear mounting box. The rear mounting box is affixed to a wall or similar mounting surface and the initial electrical connections are made through the mounting box prior to the attachment of the light fixture thereto.

2. Description of the Prior Art

In the prior art, it has been unnecessarily difficult to mount certain light fixtures as the initial wiring connections had to be made before the fixture was fully secured to the wall or ceiling. This was particularly difficult in the case of heavy light fixtures.

Similarly, the configuration of certain light fixtures made it difficult to perform the initial wiring connections as parts of the light fixture would obstruct these tasks.

Additionally, it was particularly difficult to level a heavy light fixture. Also in the prior art, supply wire connections needed to be rated for high temperatures because these wires could come into direct contact with hot electrical components. These temperature ratings ranged from 105° C. to 200° C. In addition, the prior art required that photocontrollers be mounted exterior of the fixture because of their 90° C. temperature rating.

Additionally, the prior art has not allowed for the simple conversion from recessed box mounting and wiring to surface conduit mounting and wiring.

OBJECTS AND SUMMARY OF THE INVENTION

It is therefore an object of this invention to allow an electrician installing a light fixture to perform initial electrical connections prior to the installation of the light fixture.

It is therefore a further object of this invention to allow an electrician installing a light fixture to perform initial electrical connections and leveling with a minimum of physical obstruction.

It is therefore a further object of this invention to provide a way to maintain the electrical wires within a small metal area allowing the supply wire temperature rating to be as low as 90° C. thereby reducing the installation costs.

It is therefore a still further objective of this invention to allow for a photocontroller to be mounted interior to the mounting box allowing it to run within its maximum temperature.

It is therefore a final object of this invention to achieve the above objects while allowing the easy adaptability from recessed box mounting and wiring to surface conduit mounting and wiring.

These and other objects are achieved by providing a light fixture with a detachable rear mounting box. The mounting box is attached to the wall or ceiling prior to the installation of the remainder of the fixture. All initial electrical connections are made through the box in the absence of the light fixture. After the initial electrical connections and leveling is made, the light fixture is bolted onto the mounting box. An aperture in the mounting box aligns with a corresponding aperture in the lighting fixture and the wires are drawn through these apertures into the lighting fixture.

The aperture in the box through which the wires are drawn is offset from the center of the box. This allows the box to be oriented in a first position for recessed box mounting and wiring wherein the box is substantially recessed within the light fixture. However, the box can be oriented in a second position 180° from the first position so that a substantial portion of the box is exposed from the top of the lighting fixture thereby facilitating surface conduit mounting and wiring.

BRIEF DESCRIPTION OF THE DRAWINGS

Further objects and advantages of the invention will become apparent from the following description and claims, and from the accompanying drawings, wherein:

DESCRIPTION OF THE PREFERRED EMBODIMENT

Figure 1:
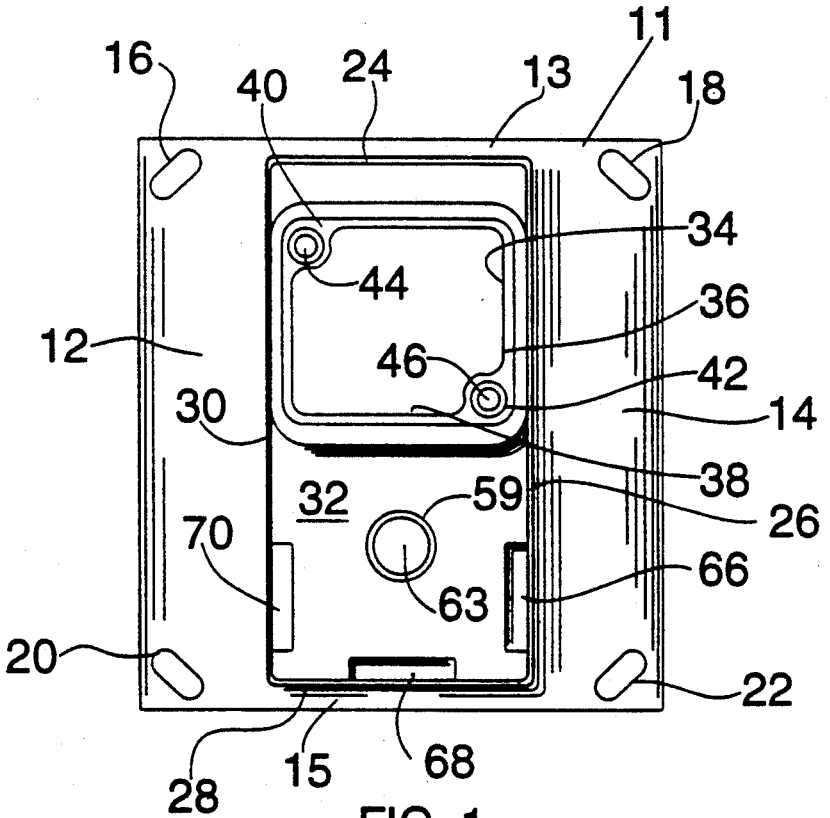
FIG. 1 is a front plan view of the mounting box.
Figure 2:
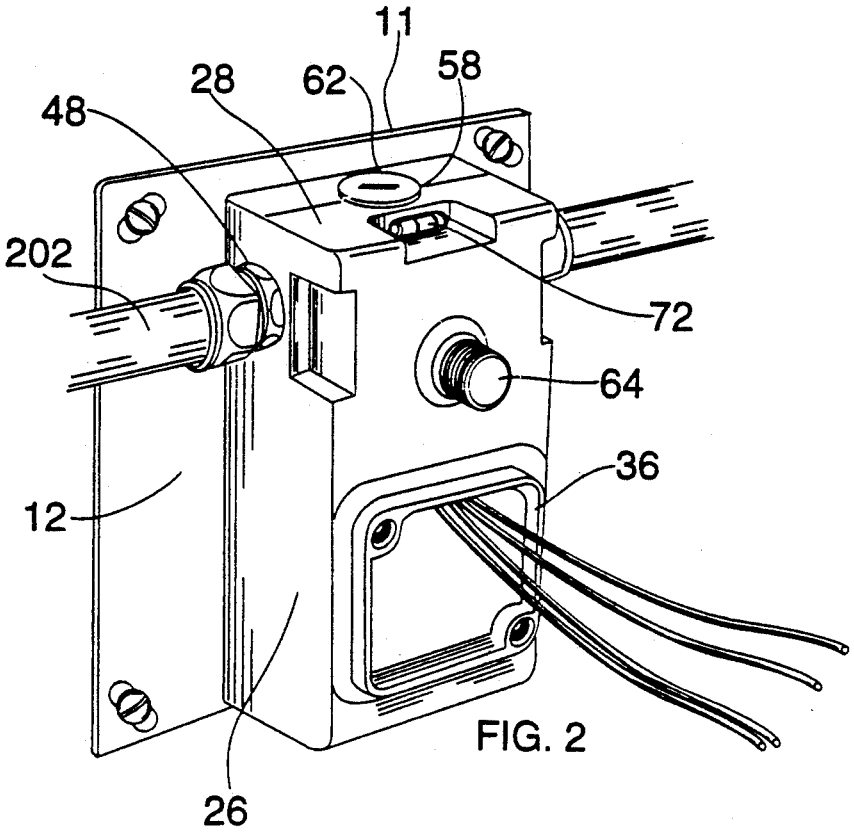
FIG. 2 is a front perspective view of the mounting box oriented for surface conduit mounting and wiring.
Figure 3:
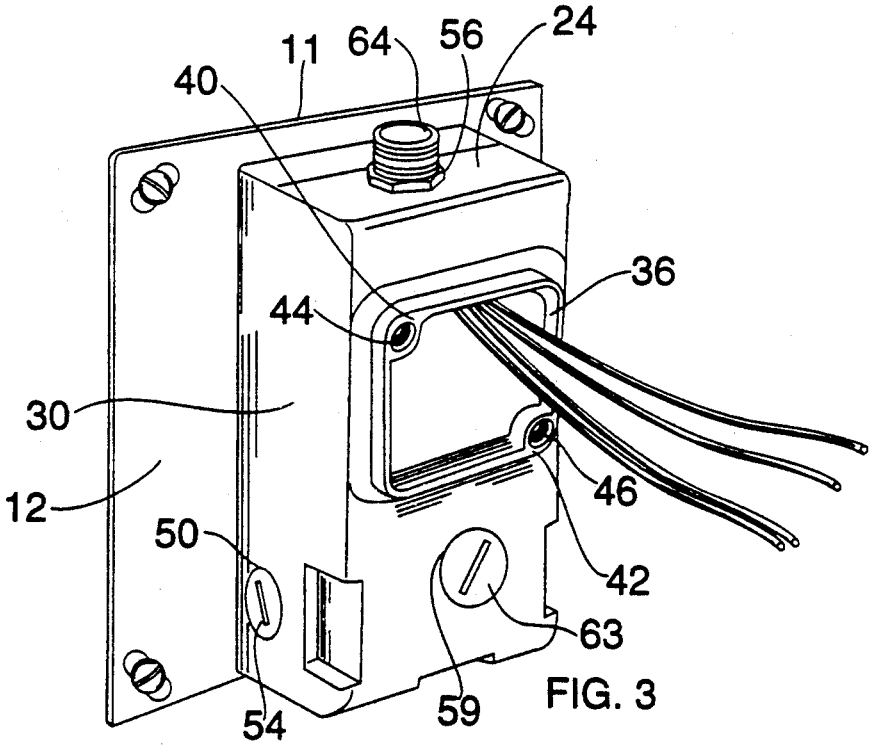
FIG. 3 is a front perspective view of the mounting box oriented for recessed box mounting and wiring (180° from the orientation shown in FIG. 2)

Referring now to the drawings in detail, wherein like numerals refer to like elements throughout the several views, FIG. 1 is a front view of mounting box 11 while FIGS. 2 and 3 are front perspective views of mounting box 11.

Mounting box 11 is preferably used in conjunction with a light fixture such as that disclosed in commonly-owned application Ser. No. 07/965,209, filed Oct. 23, 1992, entitled "Light Fixture With a Reversible Lens With Adjustable Brackets" and U.S. Pat. No. 5,249,110, issued sep. 28, 1993, filed Oct. 23, 1992, entitled "Light Fixture With Adjustable Bulb and Radiant Heat Dissipating Reflector", the disclosures of which are incorporated herein by reference.

Mounting box 11 is preferably composed of metal. Mounting box 11 includes side flanges 12, 14 with mounting apertures 16, 18, 20, 22. Side flanges 12, 14, as joined by upper and lower lips 13, 15, respectively, engage the mounting surface 200 (see FIG. 6) and apertures 16, 18, 20, 22 are used to secure mounting box 11 to mounting surface 200. Apertures 16, 18, 20, 22 are slanted to allow for adjustment of mounting box 11 to a level position even if mounting surface 200 includes slightly inaccurately placed holes. Sidewalls 24, 26, 28, 30 extend perpendicularly from the plane of side flanges 12, 14. Front wall 32, parallel to the plane of side flanges 12, 14, is formed with sides intersecting respective sides of sidewalls 24, 26, 28, 30 to form cavity 34 therewithin. Cavity 34 is open in the rear portion thereof (that is, there is an opening formed parallel to front wall 32 between flanges 12, 14 in order to allow access for electrical wires extending directly from mounting surface 200 such as in FIG. 6).

An upper portion ("upper" being used only with reference to the orientation shown in FIG. 1) of front wall 32 of mounting box 11 includes wiring aperture 36 thereby providing communication from the outside to cavity 34. The periphery of wiring aperture 36 includes an outwardly extending lip 38. Lip 38 further includes two enlarged portions 40, 42 at opposing corners of wiring aperture 36 which include bolt apertures 44, 46.

Sidewalls 26 and 30 (see FIGS. 2 and 3) include side capped apertures 48, 50, respectively. Mounting box 11 is provided with threaded cap 54 inserted into side capped aperture 50. A corresponding threaded cap not shown in the drawings is provided for side capped aperture 48. As shown in FIGS. 2, 5, and 7, side capped apertures 48, 50 are uncapped to provide access for electrical cable 202 when the mounting box 11 is oriented for the surface conduit mounting and wiring configuration. However, as shown in FIGS. 3, 4, and 6, side capped apertures 48, 50 remain capped when mounting box 11 is oriented for the recessed box mounting and wiring configuration.

Sidewalls 24, 28 include capped apertures 56, 58, respectively. Threaded caps 60, 62 are provided in capped apertures 56, 58 respectively. Front wall includes aperture 59 covered by knock-out 63. As shown in FIGS. 2, 3, 4, and 5, threaded caps 60, 62 or knock-out 63 may optionally be removed to provide an aperture chosen from apertures 56, 58 or 59 for the installation of a photocontroller 64.

Indentations 66, 68, 70 are formed at a portion of the intersections of front wall 32 with sidewalls 26, 28 and 30, respectively. Indentations 66, 68, 70 are used to engage a bubble level 72 (see FIG. 2) during the installation of mounting box 11 to assure that mounting box 11 is installed at the appropriate angle.

Figure 4:
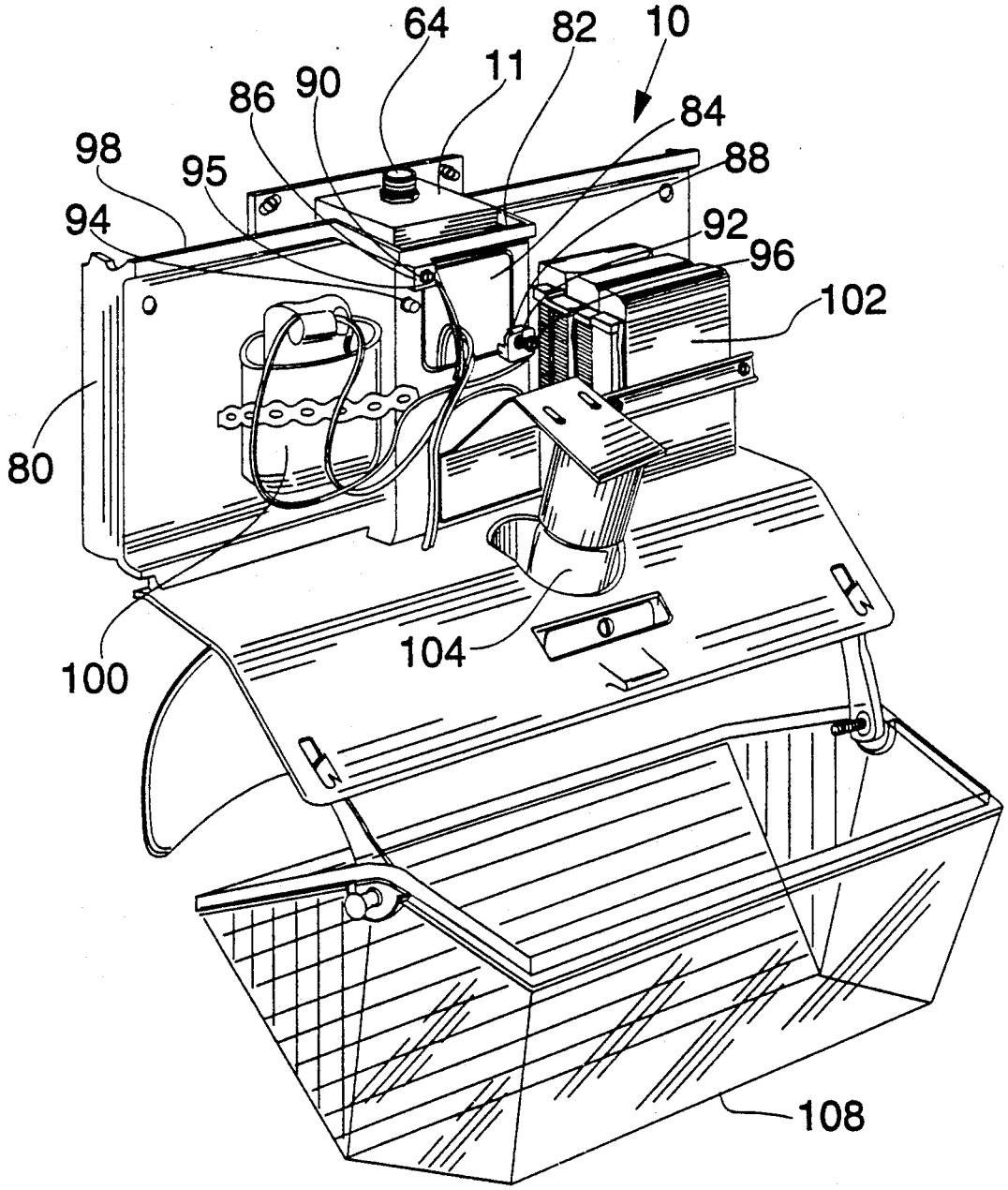
FIG. 4 is a front perspective view of the partially open light fixture as it engages the mounting box in the recessed box mounting and wiring configuration.
Figure 5:
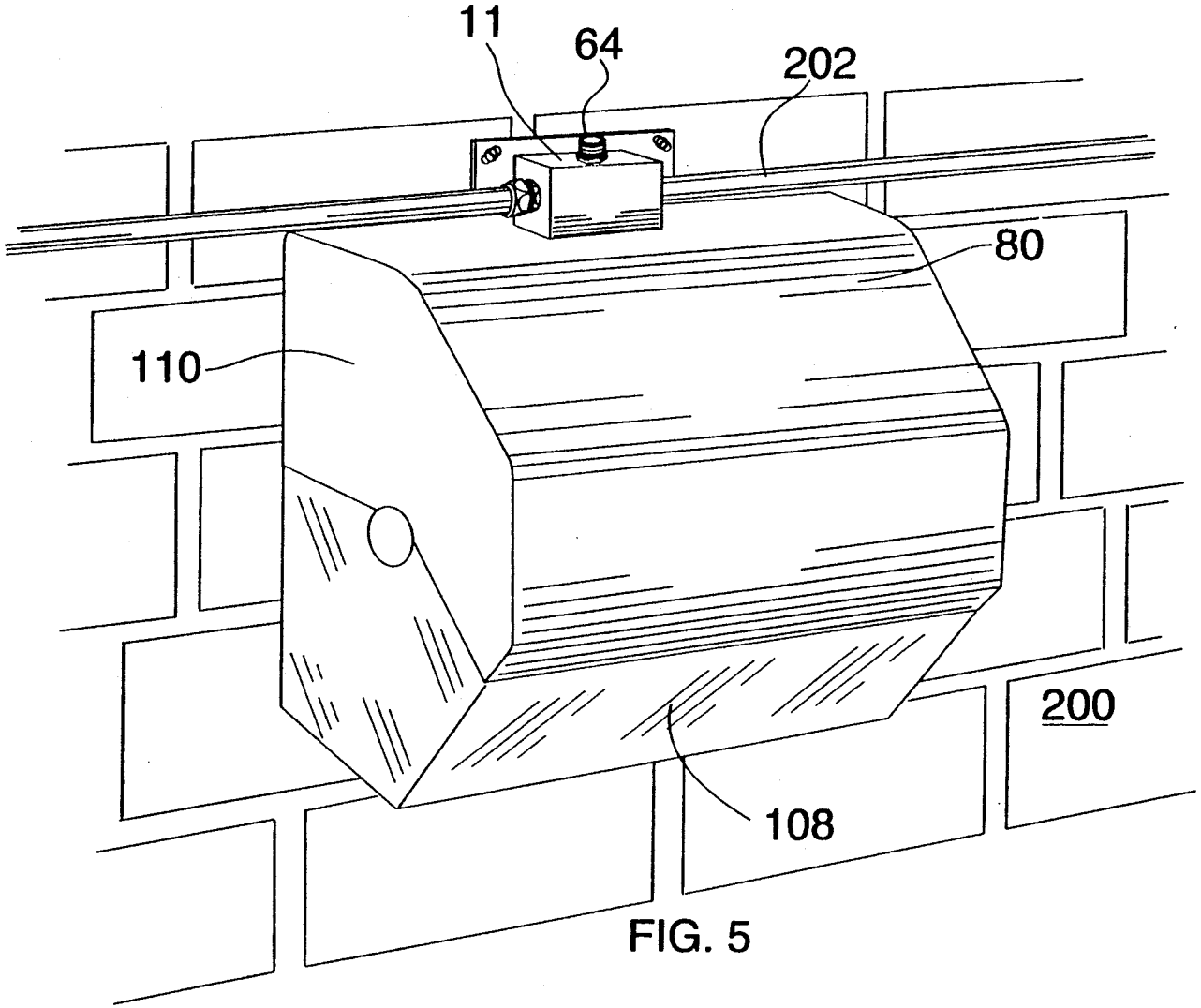
FIG. 5 is a front perspective view of the light fixture in the surface conduit mounting and wiring configuration with the mounting box after a cover has been mounted.
Figure 6:
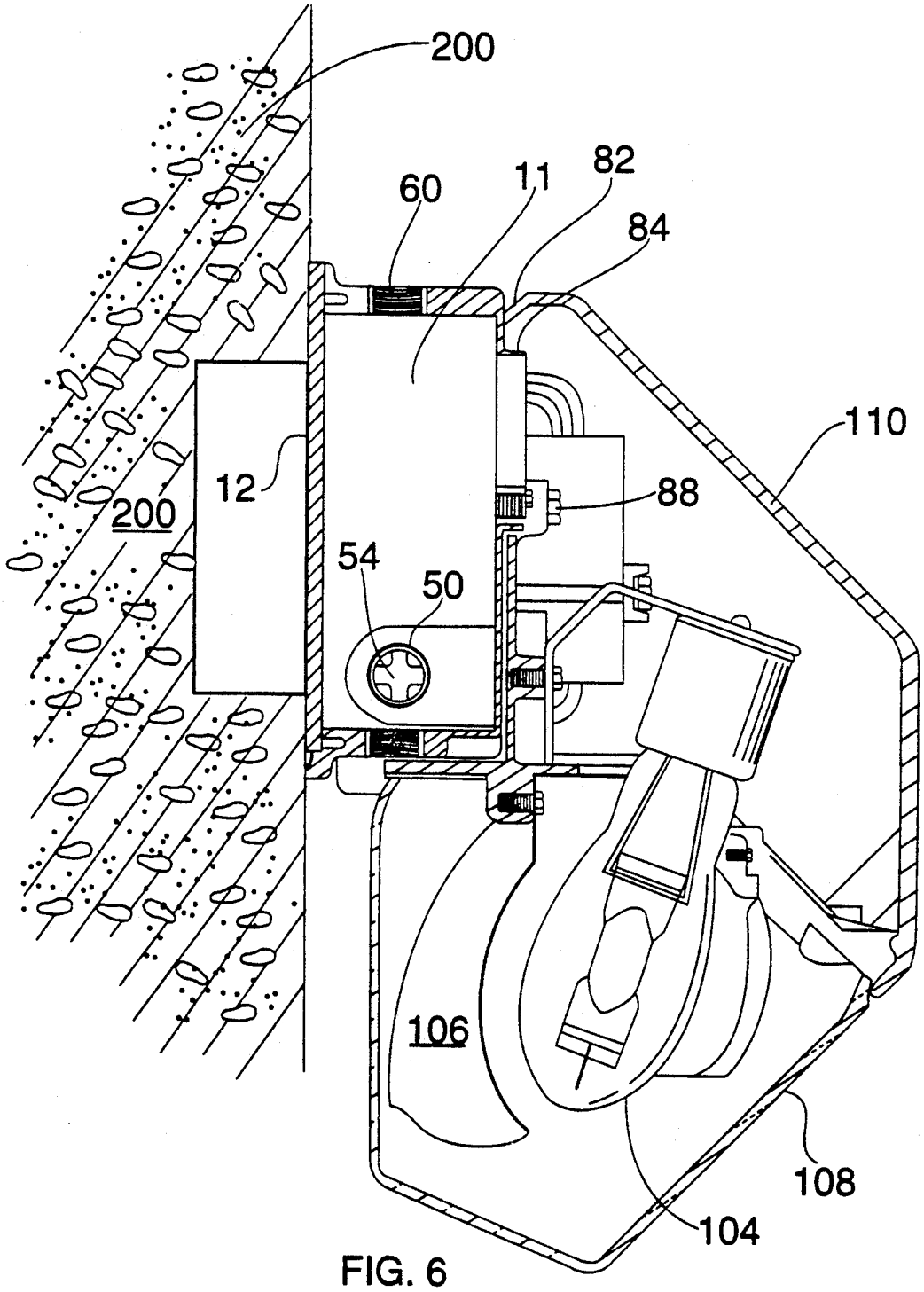
FIG. 6 is a side cross-sectional view of the light fixture in the recessed box mounting and wiring configuration.
Figure 7:
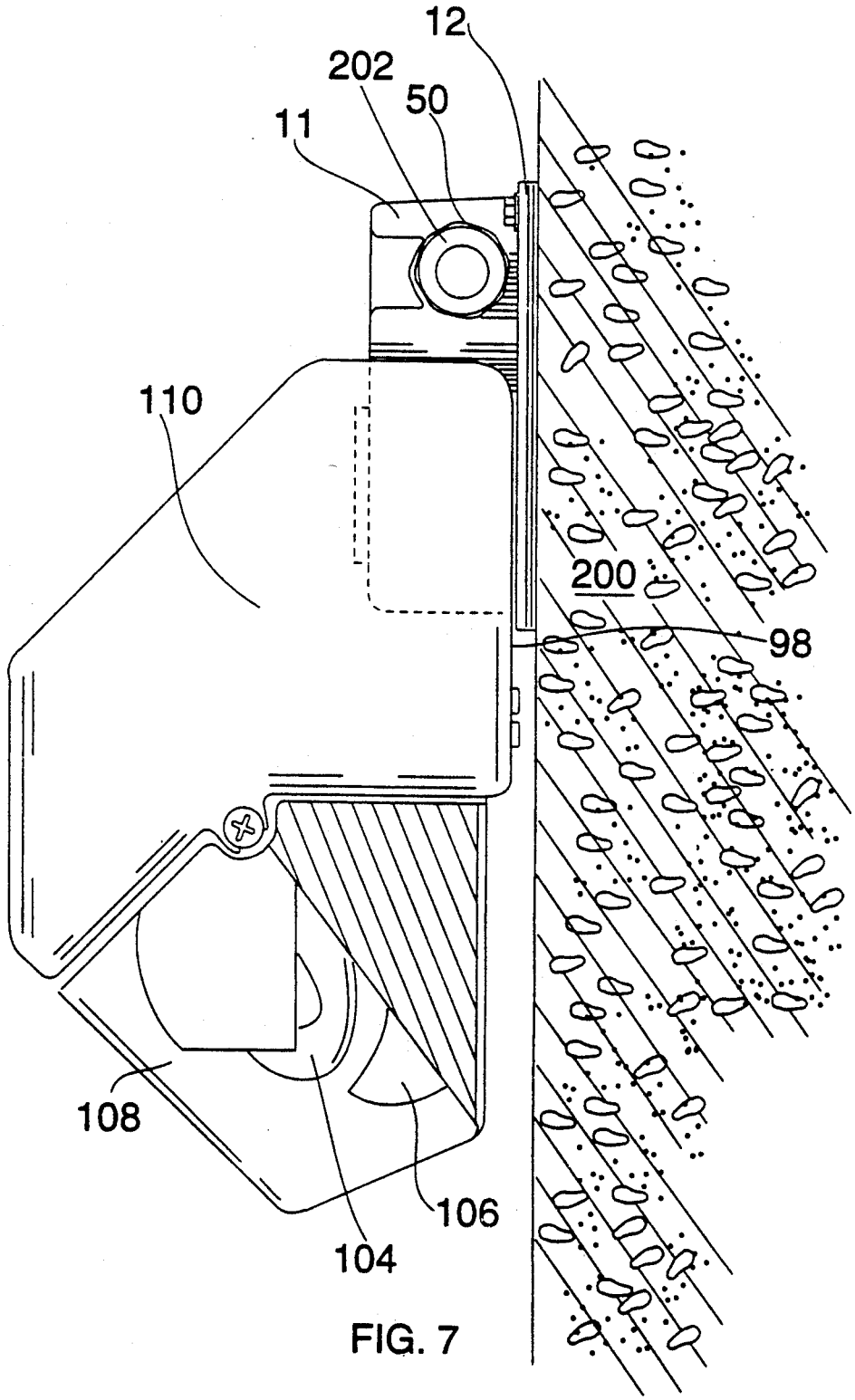
FIG. 7 is a side view, partly in phantom, of the light fixture in the surface conduit mounting and wiring configuration.

As shown in FIGS. 4–7, light fixture 10 includes component assembly 80 and mounting box 11. Component assembly 80 engages mounting box 11. More particularly, component assembly 80 includes a recessed rear wall 82 with an aperture 84 which is engaged by lip 38 of mounting box 11. Recessed rear wall 82 further includes raised flanges 86, 88 which include apertures 90, 92 which align with bolt apertures 44, 46 allowing component assembly 80 to be secured to mounting box 11 by means of bolts 94, 96 as shown in FIG. 4. Grounding lug 95 is further included on component assembly 80.

Component assembly 80 further includes rear wall 98 which is immediately adjacent to the mounting surface 200. As shown in FIG. 7, there is preferably a one half inch air gap between rear wall 98 and mounting surface 200 for air flow to cool the fixture including component assembly 80 (this is in contrast to most conventional fixtures which mount flush to the mounting surface). Rear wall 98 further provides a mounting surface for capacitor 100 and ballast 102. Component assembly further includes bulb 104, reflector 106, lower clear lens 108 and upper opaque cover 110.

In order to facilitate the orderly installation of apparatus 10, mounting box 11 and component assembly 80 are preferably packed in separate compartments of the same shipping box (not shown). This allows an apprentice electrician to install the mounting box, and the master electrician to perform the final wiring while keeping all pieces of apparatus 10 in order.

To use the apparatus described herein, before or after optionally installing photocontroller 64 (those skilled in the art will realize that the order of steps given is illustrative only, and may be changed), the user first mounts mounting box 11 on mounting surface 200 such as a wall. Mounting box 11 may be mounted in a first orientation for the surface conduit mounting and wiring configuration as shown in FIG. 2 wherein electrical power is supplied via conduit 202 through side apertures 48, 50 (with caps 52, 54 removed). Alternately, mounting box 11 may be mounted in a second orientation for recessed box mounting and wiring as shown in FIG. 3 wherein electrical power is typically supplied from wires extending directly from mounting surface 200. The user may use bubble level 72 within indentation 68 to assure the proper placement of mounting box 11.

The user then engages component assembly 80 against mounting box 11 so that aperture 84 on recessed rear wall 82 of component assembly 80 extends around the periphery of lip 38. The user secures component assembly 80 to mounting box 11 using bolts 94, 96.

The user/electrician performs the appropriate wire splicing with a view towards ground lug 95 on component assembly 80 being used.

The user then makes the appropriate electrical connections to capacitor 100 and ballast 102 according to all electrical safety codes plus the current National Electric Codes. To the extent possible, the user tucks all wires into cavity 34. Finally, the user assembles any final mechanical aspects of component assembly 80.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A lighting fixture including:

a mounting box including a planar portion for engaging a mounting surface; sidewalls extending from said planar portion and intersecting with a front wall apart from said planar portion thereby forming a cavity; said cavity including at least one first aperture for receiving electrical wires from an external source and a second aperture for providing the electrical wires to said lighting fixture; and a component assembly, detachable from said mounting box, including a recessed rear portion for engaging said mounting box; a third aperture aligning with said second aperture of said mounting box and receiving the electrical wires therethrough; a detachable cover; and means for securing said component assembly to said mounting box; whereby prior to attachment of said detachable cover but after engagement of said means for securing said component assembly to said mounting box, said second aperture, said third aperture and any electrical wires received therethrough are substantially exposed and accessible.

2. The lighting fixture of claim 1 wherein said second aperture is formed on said front wall.

3. The lighting fixture of claim 2 wherein an outwardly extending lip is formed around a periphery of said second aperture which extends through said third aperture when said mounting box is engaged against said component assembly.

4. The lighting fixture of claim 3 wherein said means for securing includes first threaded apertures in said mounting box and corresponding aligned flanges with second threaded apertures in said component assembly.

5. The lighting fixture of claim 4 wherein said at least one first aperture includes a passage through said planar portion.

6. The lighting fixture of claim 5 wherein said at least one first aperture further includes at least two opposed openings on said sidewalls.

7. A lighting fixture including:

a mounting box including a planar portion for engaging a mounting surface; sidewalls extending from said planar portion and intersecting with a front wall apart from said planar portion thereby forming a cavity; said cavity including at least one first aperture on said sidewalls for receiving electrical wires from an external source and a second aperture formed on said front wall for providing the electrical wires to said light lighting fixture;

a component assembly, detachable from said mounting box, including a recessed rear portion for engaging said mounting box; a third aperture aligning with said second aperture of said mounting box and receiving the electrical wires therethrough; and means for securing said component assembly to said mounting box; and wherein said mounting box, when oriented in a first orientation and engaged by said component assembly, is substantially recessed within said component assembly, and when oriented in a second orientation and engaged by said component assembly, has a portion thereof extended from said component assembly thereby exposing said at least one first aperture on said sidewalls thereby allowing said at least one first aperture to receive electrical wires.

8. The lighting fixture of claim 7 wherein said first orientation of said mounting box is 180° from said second orientation.

9. The lighting fixture of claim 8 wherein said mounting box includes at least one mounting aperture for photocontrolling means.

* * * * *